US007216869B1

(12) United States Patent
Gallagher et al.

(10) Patent No.: US 7,216,869 B1
(45) Date of Patent: May 15, 2007

(54) SUITS AND LADDERS GAME

(76) Inventors: L. Scott Gallagher, 133 Ousamequin Pines Rd., E. Bridgewater, MA (US) 02333; Christina L. Gallagher, 133 Ousamequin Pines Rd., E. Bridgewater, MA (US) 02333

( * ) Notice: Subject to any disclaimer, the term of this patent is extended or adjusted under 35 U.S.C. 154(b) by 122 days.

(21) Appl. No.: 11/127,597

(22) Filed: May 13, 2005

Related U.S. Application Data

(63) Continuation-in-part of application No. 11/053,563, filed on Feb. 9, 2005.

(51) Int. Cl.
*A63F 1/00* (2006.01)

(52) U.S. Cl. ..... 273/274

(58) Field of Classification Search ..... 273/292, 273/274, 309; 463/12, 13
See application file for complete search history.

(56) References Cited

U.S. PATENT DOCUMENTS 5,593,161 A * 1/1997 Boylan et al. ..... 273/274
5,718,431 A * 2/1998 Ornstein ..... 273/292
6,189,888 B1 * 2/2001 Brunelle ..... 273/292
6,439,573 B1 * 8/2002 Sklar ..... 273/292
6,550,772 B1 * 4/2003 Streeks et al. ..... 273/292
6,575,467 B1 * 6/2003 Kal ..... 273/292
6,585,588 B2 * 7/2003 Hartl ..... 463/16
6,648,754 B2 * 11/2003 Baerlocher et al. ..... 463/17
6,679,492 B2 * 1/2004 Markowiak ..... 273/138.1
7,048,274 B2 * 5/2006 Duncombe et al. ..... 273/274
7,137,629 B2 * 11/2006 Chapman ..... 273/292

* cited by examiner

*Primary Examiner*—William M. Pierce
(74) *Attorney, Agent, or Firm*—John P. McGonagle

(57) ABSTRACT

A wagering game between a dealer and one or more players involving one or more decks of cards, a plurality of betting boards and player markers. Each betting board has four betting places, each place corresponding to one of four card suits, said betting places being arranged near the bottom of the betting board. A ladder presenting progressively increasing designated odds payoff is represented above the betting places. Each player makes a bet by selecting a betting place with a marker. A dealer deals one card. If the betting place matches the suit of the card dealt, the player is a winner. The winner may accept the designated odds payoff or may continue play during the next iteration at a higher designated odds payoff. If the player's betting place does not match the suit of the card dealt, the player loses and the dealer is the winner. Players may make side bets on the value of the card dealt as agreed to between player and dealer.

4 Claims, 3 Drawing Sheets

SUITS AND LADDERS GAME

CROSS-REFERENCE TO RELATED APPLICATIONS

This is a Continuation-In-Part of U.S. patent application Ser. No. 11/053,563, filed Feb. 9, 2005.

BACKGROUND OF THE INVENTION

This invention relates to wagering games involving a dealer, one or more players, and one or more decks of cards having a plurality of suits.

Many card games have been developed and some are particularly adapted for gambling. One class of such games includes a dealer who deals cards and a plurality of players who place wagers based on the cards that the dealer deals. Various progressive jackpot wagering games have also been developed. Other games also disclose the concept of adding additional wagers when cards are dealt.

There is a demand for new card games, particularly by casinos, which are, at the same time, innovative and interesting, but simple enough for players to easily learn. It has been found that many potential players are discouraged from playing because they do not understand the complexity of the game and are self-conscious about showing their lack of expertise.

Accordingly, it is an object of the present invention to provide an improved wagering game, which is innovative and interesting.

It is also an object of the invention to provide an improved wagering game for casinos which is simple enough for most persons to understand without complicated instructions.

SUMMARY OF THE INVENTION

In accordance with these objects, there is provided, according to one aspect of the invention, a wagering game between a dealer and one or more players involving one or more decks of cards, a plurality of betting boards and player markers. Each betting board has four betting places, each place corresponding to one of four card suits, said betting places being arranged near the bottom of the betting board. A ladder presenting progressively increasing designated odds payoff is represented above the betting places. Each player makes a bet by selecting a betting place with a marker. A dealer deals one card. If the betting place matches the suit of the card dealt, the player is a winner. The winner may accept the designated odds payoff or may continue play during the next iteration at a higher designated odds payoff. If the player's betting place does not match the suit of the card dealt, the player loses and the dealer is the winner. Players may make side bets on the value of the card dealt as agreed to between player and dealer.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
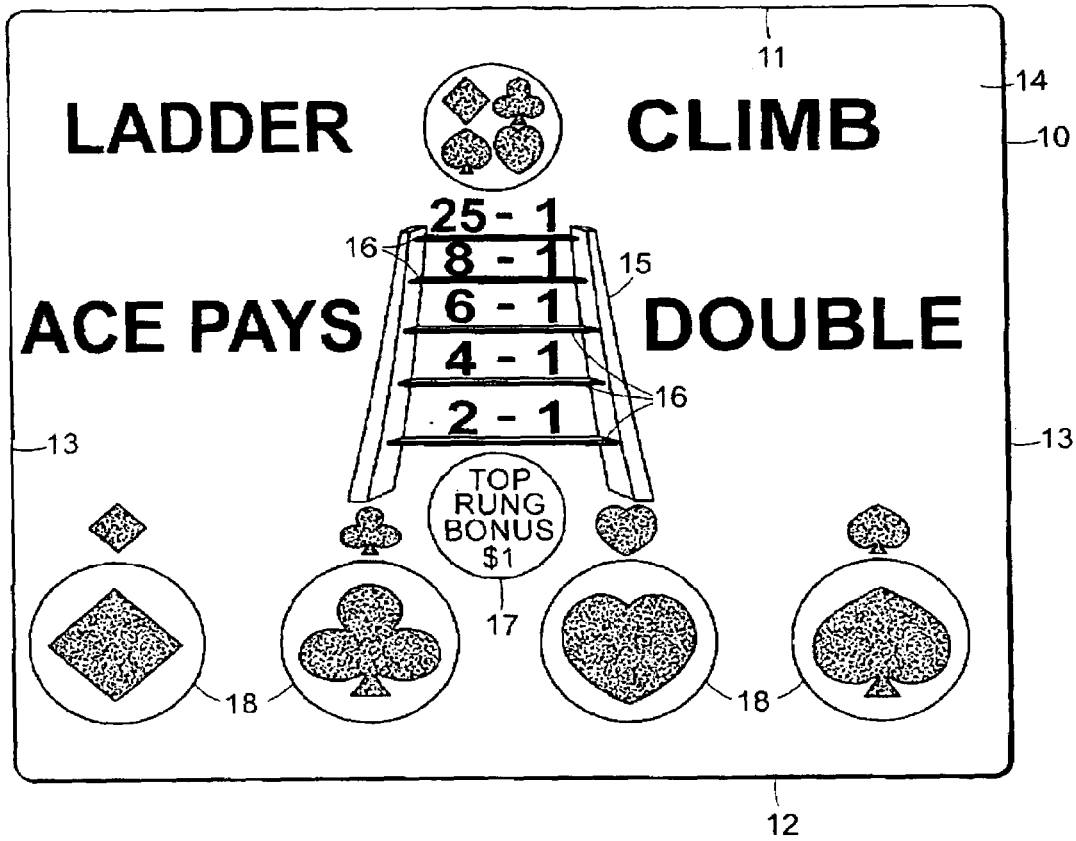
FIG. 1 is a top plan view of a betting board used in the invention.

Referring to the drawings in detail wherein like elements are indicated by like numerals, there is shown in FIG. 1 a generally rectangular, flat, player's betting board 10 having a top 11, bottom 12, two opposite side edges 13 and a playing surface 14. The playing surface 14 has a plurality of betting spaces 18 arranged into a horizontal row near the bottom 12 of the betting board 10, said betting spaces 18 representing the four suits of a standard deck of playing cards. Immediately above the row of betting spaces 18 is a representation of a ladder 15. The ladder has a plurality of rungs 16 representing progressively increasing designated odds payoff, with the rung closest to the betting board bottom 12 being set at the lowest odds. The odds progress as the rungs move toward the betting board top 11, with the rung 16 closest to the betting board top 11 having the greatest odds. In this embodiment of the invention, the row odds progress as follows: 2:1, 4:1, 6:1, 8:1, and 25:1. Other embodiments may have different odds.

Figure 2:
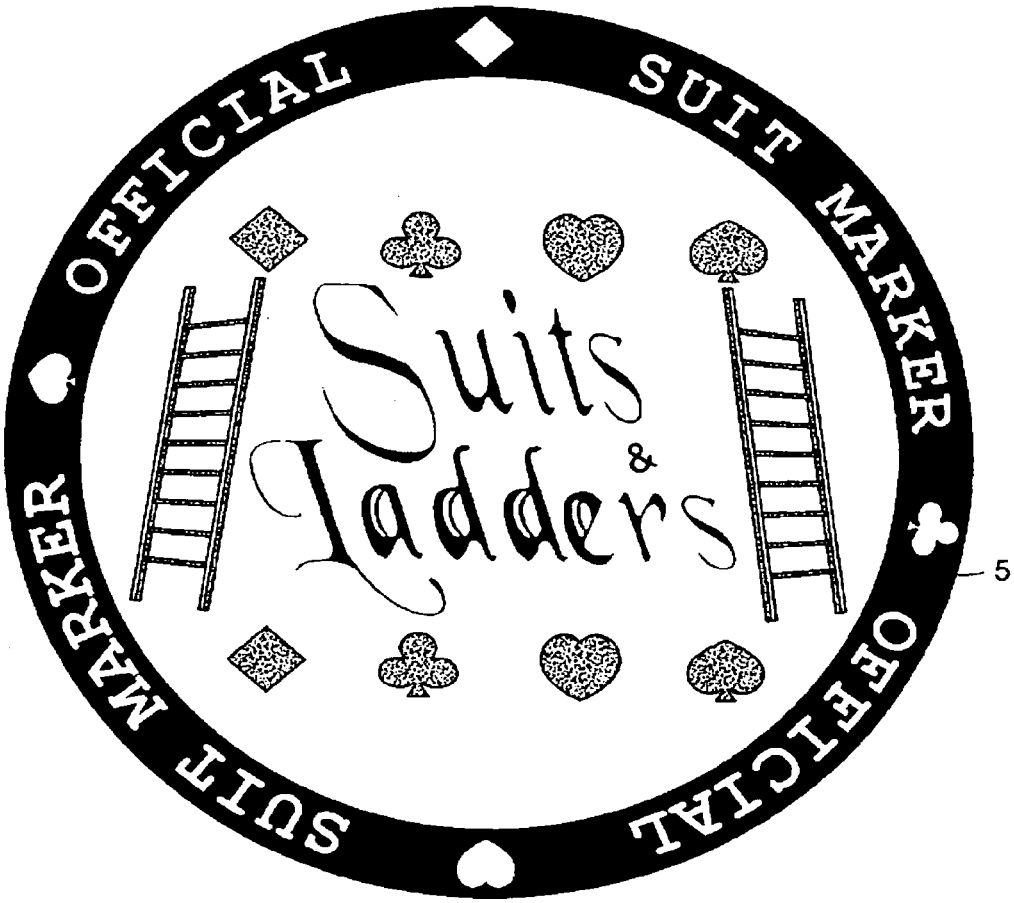
FIG. 2 is a top plan view of a marker used in play.
Figure 3:
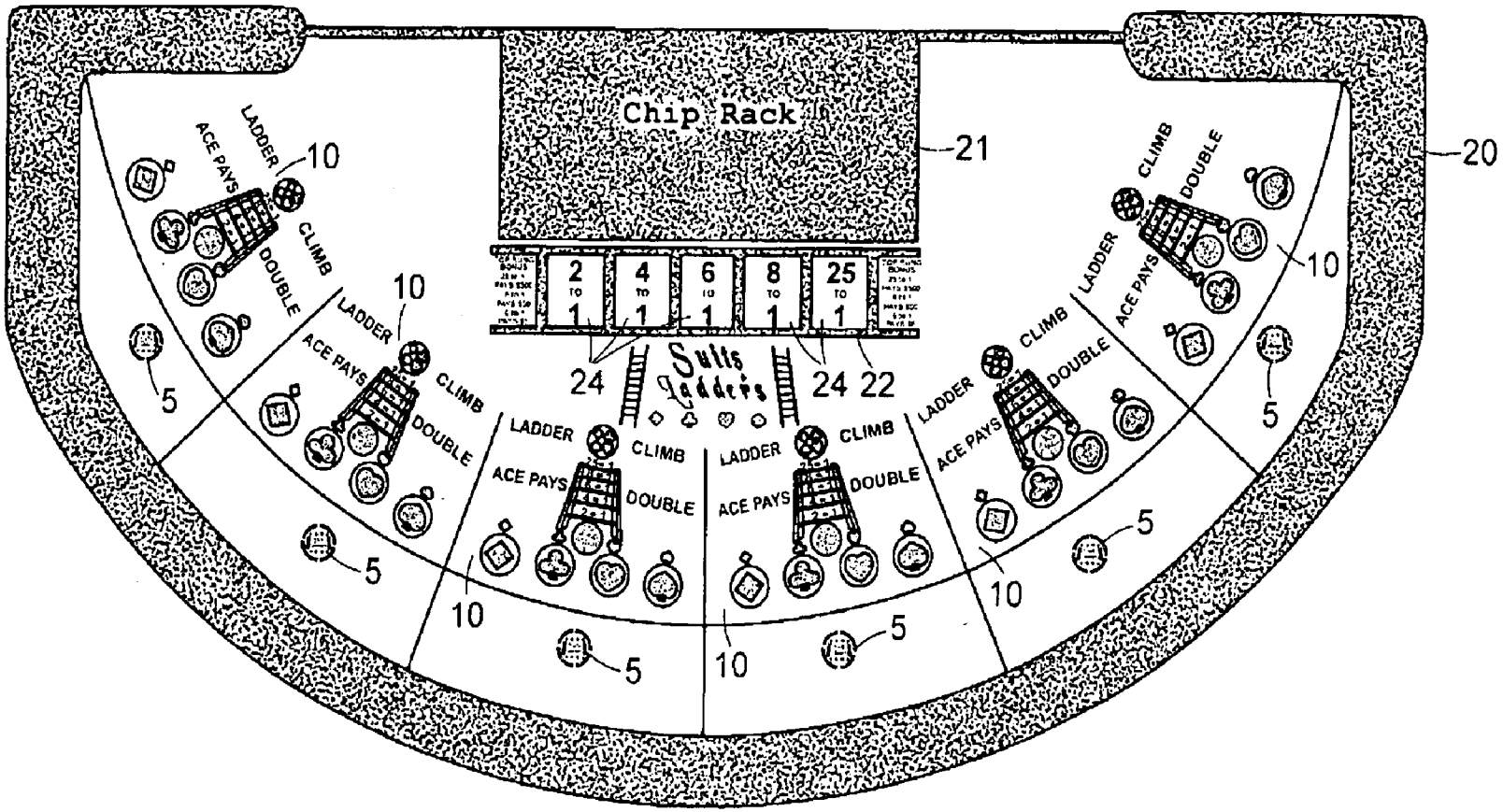
FIG. 3 is a top plan view of a table layout with multiple betting boards for multiple players.

FIG. 2 represents a typical betting marker 5 used in the game. FIG. 3 illustrates a typical betting board table layout 20 for the game, including a chip rack area 21 and a dealer ladder area 22. There is also a plurality of betting areas 23, each area having a betting board 10 imprinted thereon.

A player places a wager (bet) on any one, two, three or four of the four suit positions 18 on the bottom of the individual player's betting board 10 by placing his marker(s) 5 on a desired betting space(s) 18. The player then lays his bet amount on the ladder 15 above the row of betting spaces 18. The dealer places his own marker 5 on an odds position 24 in the dealer ladder area 22 which indicates to all players the odds of the bet. The odds position 24 corresponds to the ladder rungs 16 on the betting board 10. The dealer starts a round of play by placing his marker 5 in the lowest odds position 24. The dealer then flips a single card for play in the designated dealer ladder odds position 24. Those players who have placed their markers on a betting space 18 matching the suit of the card flipped by the dealer win. All other players lose. The dealer then collects any unsuccessfully selected (mismatched) wagers.

If the player or player's wager has successfully selected (matched) the suit on the dealt card, the dealer then moves the wager up into the ladder climb area and pays the appropriate odds, e.g., 2-1, designated for that rung. The game of the present invention revolves around bets on specific card suits. A player placed a wager on any one or two of the four betting spaces on the player's field area or card. The dealer flipped a single card for play. If the player had successfully selected (matched) the suit on the dealt card, the dealer is required to pay the appropriate odds designated for that row. The player, at his option, can collect his winnings or now continue to play at the increased odds of the next dealer ladder area odds position 24. If the player elects to continue play, the round continues and the winning players wager is placed on the ladder 15 and ready to climb. This round of play is now closed to any player that has failed to match a suit with their wager.

The dealer then instructs any player or players with a wager in the ladder climb area to use their suit marker 5 and select any one of the suits indicated in the betting spaces 18. The dealer then flips a single card for play on the next rung 24 of the odds designated ladder 22.

If the player has successfully selected (matched) the suit of the flipped card with his suit marker 5, the dealer then pays the appropriate odds designed by the odds position 24. If a player is unsuccessful in matching the dealt suit, the dealer then collects the wager from the player's ladder climb area 15 and that player is dropped from the present round. The player must wait and begin again at the bottom of the player's betting board when the next round begins.

The game becomes open again for the whole table to wager when there are no more bets left in the ladder climb area. A round of game play continues until a player or players reach the top rung of the ladder matching all suits successfully or failing to match a suit on a ladder rung.

In this embodiment of the invention, an ace pays double. If the dealer flips an ace, and a player has correctly selected the proper suit, the dealer then pays the player double the appropriate odds designated for that play.

In another embodiment of the invention, a player may make optional side bets. In this embodiment of the invention, the player places an additional marker on the space 17 designated "top Rung Bonus." The side bet may be $1.00. If the player reached and successfully matches the suit on the second last rung, the dealer pays a $50.00 bonus. If the player reaches and successfully matches the suit on the last rung, the dealer pays a $500.00 bonus. Other bet amounts and bonus amounts may be made in other embodiments of the game.

It is understood that the above-described embodiment is merely illustrative of the application. The house or casino may have the option for a single deck deal or multiple deck deal. Other embodiments may be readily devised by those skilled in the art which will embody the principles of the invention and fall within the spirit and scope thereof.

We claim:

1. A method of playing a wagering card game between a dealer and a plurality of players using a plurality of fifty-two card decks having four suits, comprising the sequential steps of:

providing a betting board table surface, including a chip rack area, a dealer ladder area having a plurality of odds positions, and a plurality of betting areas, each betting area having a betting board imprinted thereon, each said betting board having a top, a bottom, two opposite sides and a playing surface, said playing surface having a plurality of betting spaces arranged into a horizontal row near to said betting board bottom, said betting spaces representing said four suits, said betting board having a ladder above said betting spaces extending toward the betting board top, said ladder having a plurality of rungs representing progressively increasing designated odds payoffs, wherein the rung closest to the betting board bottom is set at the lowest odds, and the rung closest to the betting board top is set at the greatest odds, said dealer ladder odds positions corresponding to the ladder rungs on the betting boards;

each player being assigned to a betting area;

each player placing a marker on a plurality of the four betting spaces on the bottom row in the player's assigned betting area;

each player placing a wager amount on the ladder in the player's assigned betting area;

the dealer placing a marker on an odds position with a lowest odds payoff;

the dealer flipping a single card for play showing one of four said suits;

the dealer paying an amount designated by said odds position with a dealer marker to each player with a designated betting area who has placed a marker on a betting space matching the suit of the card flipped for play;

the dealer collecting the wagers of all players failing to match the suit of the card flipped for play;

each player having successfully selected the suit on the flipped card, at his option, keeping his winning wager up on the ladder in his assigned betting area and placing a marker on a plurality of the four betting spaces on the bottom row in the player's assigned betting area;

the dealer placing a marker on an odds position with the next highest odds payout;

the dealer flipping a single card for play showing one of four said suits;

the dealer paying an amount designated by said odds position with a dealer marker to each player with a designated betting area who has placed a marker on a betting space matching the suit of the card flipped for play;

the dealer collecting the wagers of all players failing to match the suit of the card flipped for play;

repeating the above steps until the dealer completes the game at the odds position with the highest odds payout, or all remaining players fail to match a suit on any row; and the dealer collecting each wager of a player who unsuccessfully selects a dealt suit.

2. A method of playing a wagering game as recited in claim 1, further comprising:

the dealer paying a player double the payoff odds if an ace is flipped by the dealer and the player has correctly selected the proper suit.

3. A method of playing a wagering game as recited in claim 2, further comprising:

providing each betting board with a top ring bonus space;

a player making a side bet by placing a marker on the top ring bonus in his designated batting area;

the player making a side bet designating a side bet wager amount; and the dealer paying the player making a side bet a designated multiple of said side bet wager amount if the player successfully plays the game and matches the suit of the card flipped for play when the dealer has marked the odds position with the second highest odds payout.

4. A method of playing a wagering game as recited in claim 3, further comprising:

the dealer paying the player making a side bet a designated multiple of said side bet wager amount if the player successfully plays the game and matches the suit of the card flipped for play when the dealer has marked the odds position with the highest odds payout.

* * * * *